US005656085A

United States Patent [19]

Hezel

[11] Patent Number: 5,656,085

[45] Date of Patent: Aug. 12, 1997

[54] PAINT SPRAY APPARATUS WITH REMOTE PUMP DRIVE

[75] Inventor: Thomas Hezel, Asperg, Germany

[73] Assignee: Behr Systems, Inc., Auburn Hills, Mich.

[21] Appl. No.: 564,539

[22] Filed: Nov. 27, 1995

[51] Int. Cl.[6] ..... B05B 3/02

[52] U.S. Cl. ..... 118/323; 239/227; 239/237

[58] Field of Search ..... 118/323, 326; 239/227, 263.3, 237, 242, 264; 222/333, 404

[56] References Cited

U.S. PATENT DOCUMENTS

| | | | |
|---|---|---|---|
| 4,019,653 | 4/1977 | Scherer et al. | 221/1 |
| 4,493,286 | 1/1985 | Carson | 118/677 |
| 4,745,011 | 5/1988 | Fukuta et al. | 427/421 |
| 4,822,647 | 4/1989 | Nozaki et al. | 427/421 |
| 5,225,239 | 7/1993 | Ostin | 427/421 |
| 5,351,885 | 10/1994 | Manabe | 239/264.3 |

*Primary Examiner*—Donald E. Czaja
*Assistant Examiner*—Calvin Padgett
*Attorney, Agent, or Firm*—Howard & Howard

[57] ABSTRACT

A paint spray apparatus for painting a vehicle in a paint spray booth includes a paint spray arm, a pump, and a motor and transmission adapted to drive the pump. The paint spray arm is disposed within the paint spray booth and has a nozzle disposed at a free end of the paint spray arm. The pump is mounted on said paint spray arm adjacent the nozzle. The motor is disposed remote from the pump outside the paint spray booth. The transmission drives the pump from the motor. In one embodiment, the paint spray arm may move in several planes. The transmission is adapted to allow for movement of the paint spray arm in the plane while the motor drives the pump. In a preferred embodiment, separate motors are provided which actuate the paint spray arm in the planes.

19 Claims, 2 Drawing Sheets

PAINT SPRAY APPARATUS WITH REMOTE PUMP DRIVE

BACKGROUND OF THE INVENTION

The present invention relates to a paint spray apparatus used to paint vehicles in a paint spray booth. The paint spray apparatus includes a pump driven remotely by a motor through a transmission to provide safe and effective painting of a vehicle.

In the automotive industry, paint is applied to vehicles as they travel along an assembly line. Paint is typically supplied to a nozzle by a pump for application to the vehicle. A single paint spray apparatus may be used to apply a number of different paint colors to different vehicles. For example, a paint spray apparatus may be used to apply one color paint to a vehicle, then used to apply a different paint composition to the next vehicle. The fluid connection and lines between the pump and nozzle must be cleaned out to remove the first paint color before the second paint color can be applied to the vehicle. Thus, it is desirable to minimize the distance between the pump and nozzle, i.e., keep the length of the connection between the pump and nozzle as short as possible.

On the other hand, because paint spray compositions contain volatile solvents, the atmosphere in paint spray booths are considered possibly explosive. Typically, any component which may potentially cause such atmosphere to ignite is typically kept outside the paint spray booth. In particular, electrical components of a paint spray apparatus are located outside the paint spray booth. Thus, the pump motor is typically outside the paint spray booth.

SUMMARY OF THE INVENTION

The paint spray apparatus of the present invention includes a nozzle disclosed at a free end of a moving paint spray arm. The paint spray arm is disposed within the paint spray booth. Vehicles travel through said paint spray booth for application of paint. The paint spray arm moves along a vertical axis between an upper end of the vehicle and a lower end of the vehicle. The paint spray arm also moves along a horizontal longitudinal axis towards and away from the vehicle. The nozzle disposed at the free end of the paint spray arm also pivots about a swivel point.

The paint spray apparatus includes a pump mounted on the paint spray arm adjacent the nozzle. A fluid connection runs from a supply of paint to the pump and then to the paint spray nozzle. Thus, the length of the fluid connection carrying the paint from the pump to the paint spray nozzle is minimized. Purging and cleaning of this line is simplified.

The paint spray apparatus also includes a motor and transmission adapted to drive the pump. The motor is disposed remote from the pump, and outside the paint spray booth. A transmission extends between the motor and pump. Since the paint spray arm, nozzle and pump must move in several planes within the paint spray booth, the transmission transfers actuation from the motor to the pump while still allowing relative movement. In one embodiment, the transmission comprises a series of connections to allow transfer of rotation from the motor to the pump, while still allowing relative movement. In one embodiment, a first rod is driven by the motor, and a second rod drives the pump. The rods have a plurality of elongate teeth or splines extending from an outer periphery of the rod. The teeth or splines run along substantially the entire length of the rod. Gear and belt combinations comprising a disk gear having a plurality of ridges along the inner periphery of the disk gear facilitate the relative movement. The teeth or splines of the rod cooperate with the inner ridges of the disk gear to transfer rotation of the rod to the disk gear while allowing axial movement. The disk gear may also have ridges or nubs along the outer periphery of the disk gear. The outer ridges or nubs of the disk gear cooperate with ridges of the belt to transfer rotation of the gear to the belt. A second disk gear cooperates with the belt to transfer the rotation to the second gear. This second gear is associated with a second rod to transfer rotation to the second rod but allow axial movement in a similar manner.

These and other features of the present invention will be best understood from the following specification and drawings, of which the following is a brief description.

DETAILED DESCRIPTION OF A PREFERRED EMBODIMENT OF THE INVENTION

Figure 1:
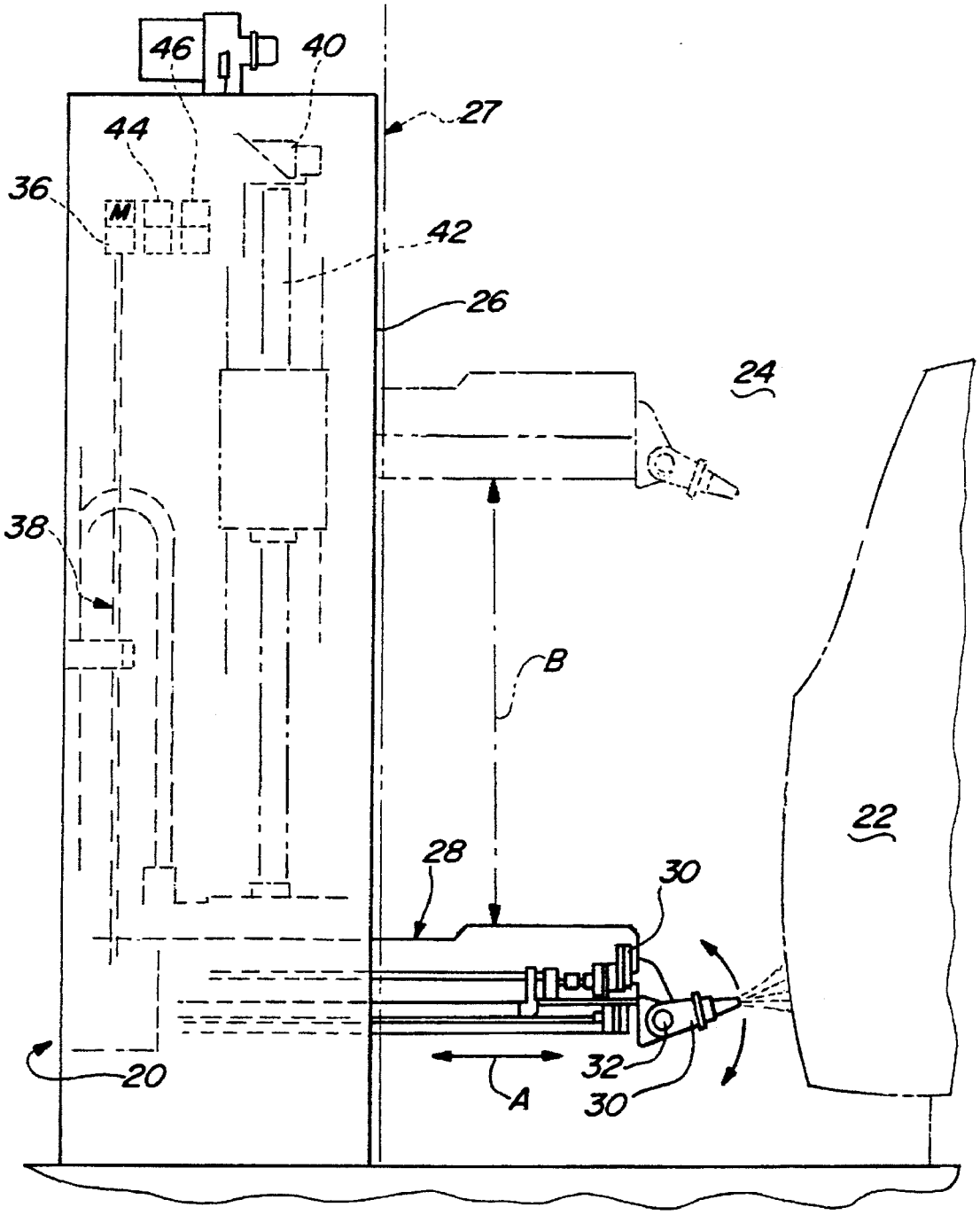
FIG. 1 is a side elevation view of a paint spray apparatus in accordance with the present invention.

A paint spray apparatus 20 paints vehicle 22 in paint spray booth 24. Spraying a paint spray composition in the booth creates a volatile atmosphere. Thus, it is preferable to locate electrical components outside paint spray booth 24. A wall 26 of paint spray apparatus 20 forms a portion of an inner face 27 of paint spray booth 24. Wall 26 may be formed integral with inner face 27 or may abut or complement a section of inner face 27.

As shown in FIG. 1, paint spray apparatus 20 includes a paint spray arm 28 disposed within the paint spray booth 24. Paint spray arm 28 moves in horizontal directions, i.e., along axis A relative to wall 26. Thus, paint spray apparatus 20 can accommodate different vehicle body styles and can be positioned at an appropriate distance from vehicle 22 according to the vehicle body style. Paint spray arm 28 also moves vertically, i.e., along axis B relative to wall 26. Thus, paint spray arm 28 can be positioned at different heights of vehicle 22 to provide coating at different locations on vehicle 22. Thus, paint spray arm 28 moves in a plane defined by axes A and B. Preferably, this plane is essentially perpendicular to a longitudinal axis of the paint spray booth along which vehicles 22 travel through the paint spray booth.

The paint spray apparatus of the present invention also includes a nozzle 30 disposed at a free end of the paint spray arm 28. Nozzle 30 is pivotally mounted at the free end of paint spray arm 28 and pivots about a swivel point 32 of paint spray arm 28. Thus, with paint spray arm 28 moveable along axis B (up and down in FIG. 1), and along axis A (left and right in FIG. 1), and with nozzle 30 pivoting about swivel point 32, paint spray arm 28 can efficiently and accurately apply a paint spray composition as vehicle 22 travels through paint spray booth 24. The structure for achieving this movement is known.

Paint spray apparatus 20 includes a pump 34 disposed adjacent nozzle 30 in paint spray arm 28. Pump 34 supplies a paint composition to nozzle 30 from a source of paint (not shown). Pump 34 is driven by motor 36 through a transmission intermediate pump 34 and motor 36, described further below. Pump 34 is preferably disposed adjacent nozzle 30 to minimize the distance paint has to travel in the line between pump 34 and nozzle 30. A single paint spray apparatus is used to sequentially paint vehicles different colors. Each time paint spray apparatus 20 is used to apply a different paint composition to a vehicle, nozzle 30 and the fluid connection between pump 34 and nozzle 30 must be purged of the old paint composition and cleaned prior to pumping a new paint composition through nozzle 30 and the line between pump 34 and nozzle 30. Thus, in this invention pump 34 is locating adjacent nozzle 30, thus minimizing the purging and cleaning of nozzle 30 and the line between pump 34 and nozzle 30.

Motor 36 for driving pump 34 is disposed remote from pump 34 off the paint spray arm 28, and outside paint spray booth 24. Thus, electrical components of the paint spray apparatus 20 to the motor are located outside paint spray booth 24. Motor 36, in conjunction with transmission 38 (described in further detail below) drives pump 34.

Because motor 36 is located a significant distance remote from pump 34, a transmission 38 intermediate pump 34 and motor 36 allows the necessary relative movement. Motor 36 and transmission 38 are adapted to drive pump 34. Transmission 38 must also be adapted to accommodate movement of the paint spray arm 28 relative to the motor 36, in the plane defined by axes A and B, i.e., up and down, and left and right as shown in FIG. 1.

Motor 40 is provided in paint spray apparatus 20 for actuation of paint spray arm 28 along axis B (up and down in FIG. 1). Motor 40 drives belt 42 which is connected to paint spray arm 28. Additional motors 44 and 46 move paint spray arm along axis A (left and right in FIG. 1) and pivot nozzle 30 about swivel point 32, as described below.

Figures 2, 3, 4:
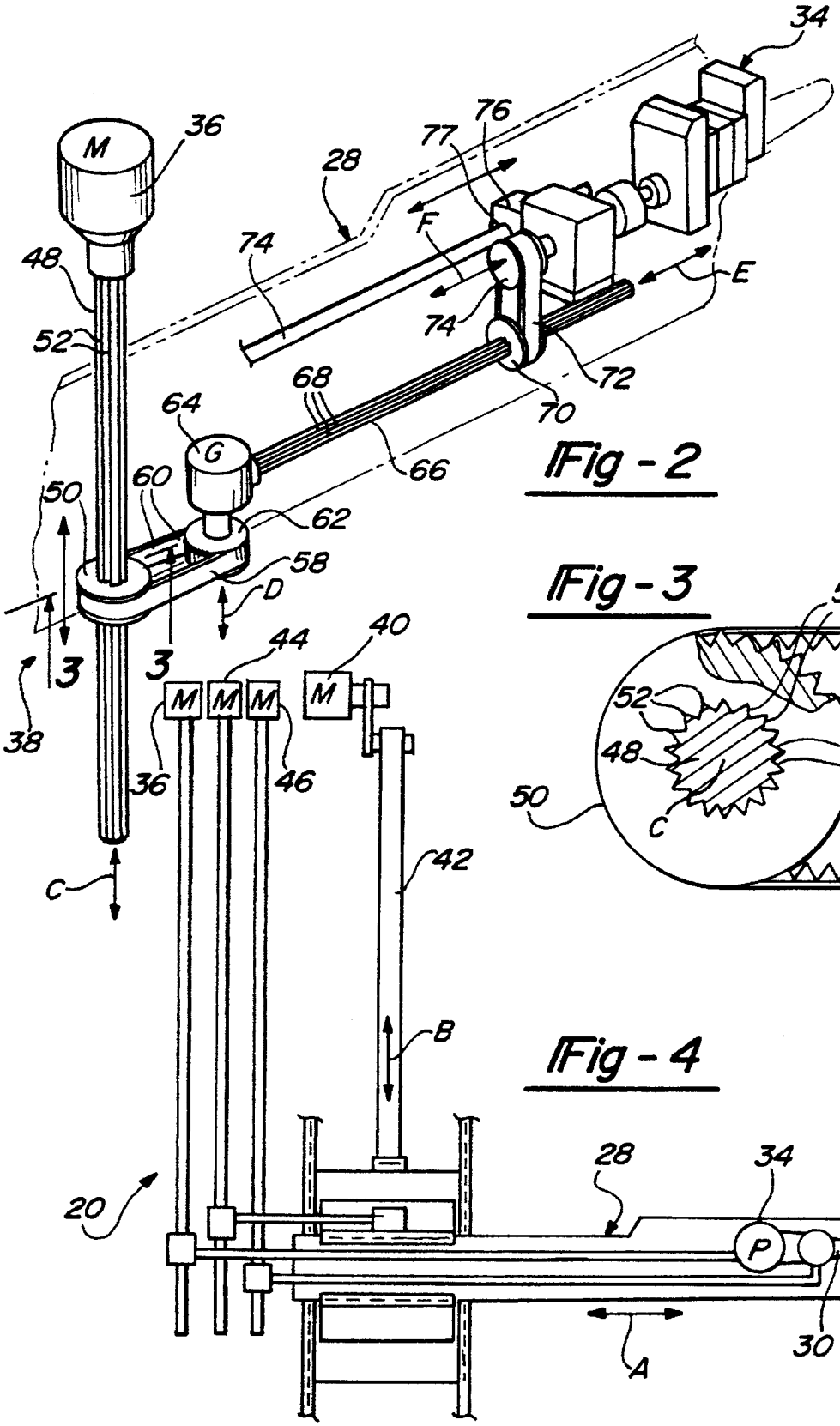
FIG. 2 is a perspective view of one portion of the paint spray apparatus of the present invention.
FIG. 3 is a cross-sectional view of the paint spray apparatus of FIG. 2 along view lines 3—3.
FIG. 4 is a partially schematic diagram of a portion of the inventive paint spray apparatus.

FIG. 2 shows one embodiment of transmission 38. Motor 36 rotates a rod 48 which runs along a vertical axis C, parallel to axis B. Rod 48 rotates about axis C which turns gear 50. Rod 48 has a plurality of longitudinal, elongate teeth 52 around the periphery of rod 48. Gear 50 has a disk shape and includes an inner bore having a plurality of ridges. Ridges 54 match and closely receive teeth 52 of rod 48 such that rotation of rod 48 rotates disk gear 50, but still allows relative axial movement along axis C.

As shown in FIG. 3, disk gear 50 has a plurality of outer ridges 56 which are disposed along the outer periphery of disk gear 50. Belt 58 includes a plurality of mating ridges 60 which mate with outer ridges 56 of disk gear 50. As disk gear 50 rotates about axis C, belt 58 is driven. Belt 58 then rotates a disk gear 62. Disk gear 62 has a similar design to disk gear 50. A gear assembly 64 includes bevel gears to transfer the rotation of disk gear 62 about axis D to rotation of a rod 66 along a vertical axis E. Gear assembly 64 is of the type well known in the art.

Rod 66 has a similar design to rod 48. A plurality of splines 68 run along the length of rod 66. Splines 68 interlock with a plurality of inner ridges of a disk gear 70. Disk gear 70 is similar to disk gear 50 and has a plurality of outer ridges that contact a plurality of belt ridges of a belt 72. As with belt (50, belt 72 transfers the rotation of disk gear 70 to a gear 74. Gear 74 rotates about a horizontal axis F and drives pump 34.

When paint spray arm 28 moves along vertical axis B (up and down in FIG. 2), disk gear 50 moves vertically along rod 48 while motor 36 is rotating rod 48. Thus disk gear 50 may move along substantially the entire length of rod 48 while it rotates with rod 48. As shown in FIG. 3, inner ridges 54 of disk gear 50 closely receive teeth 52 of rod 48 while disk gear 50 moves vertically along axis C. Thus, while arm 28 moves up and down along axis B, motor 36 is able to actuate rod 48 which drives disk gear 50 regardless of the vertical position of arm 28.

Additionally, because paint spray arm 28 can move horizontally along axis A (left and right in FIG. 2), rod 66 drives disk gear 70 regardless of the horizontal position of arm 28 relative to rod 66. The inner ridges of disk gear 70 closely receive splines 68 of rod 66. Thus, rotation of rod 66 drives disk gear 70, belt 72, and gear 74, while gear 70, belt 72, gear 74 and pump 34 may move along axis A. Paint spray arm 28 also includes a support bracket 76 having a bore 77 which receives support rod 74. Bracket 76 and rod 74 support the cantilever weight of paint spray arm 28, thus making it easier for gear 70 to slide along rod 66.

As shown in FIG. 4, paint spray apparatus 20 includes a plurality of motors 36, 44, 46 and 40 which control various functions of the apparatus. Known transmissions allow motors 36, 44, 46 and 40 to transmit the movements described above as the paint spray arm 28 moves. The transmissions are shown schematically, as they form no portion of this invention.

A preferred description of this invention has been disclosed; however, a worker of ordinary skill in the art would recognize that certain modifications would come within the scope of this invention. For that reason, the following claims should be studied in order to determine the true scope and content of this invention.

I claim:

1. A paint spray apparatus for painting a vehicle in a paint spray booth comprising:

a paint spray arm movably disposed within said paint spray booth, and having a nozzle disposed at a free end of said paint spray arm;

a pump mounted on said paint spray arm adjacent said nozzle and movable with said arm; and a motor and transmission adapted to drive said pump, said motor disposed away from said pump, outside said paint spray booth and said transmission being intermediate said pump and motor, and driven by said motor for driving said pump.

2. The paint spray apparatus as recited in claim 1, wherein said paint spray arm is movable in a plane defined by a horizontal longitudinal axis of said paint spray arm and a vertical axis, and said transmission adapted to accommodate said paint spray arm movement.

3. The paint spray apparatus as recited in claim 2, wherein said transmission comprises a plurality of rods and a plurality of gear combinations, said rods and said gear combinations adapted to transfer the rotation of said motor through said transmission to drive said pump.

4. The paint spray apparatus as recited in claim 3, wherein said rods each have a non-circular outer periphery extending along substantially the entire length of said rods, said gear combinations each comprising a disk gear having an inner periphery of said disk gear corresponding to said outer periphery, each of said gear combinations movable along said length of one of said rods.

5. The paint spray apparatus as recited in claim 4, wherein a first rod and a first gear combination allows movement of said paint spray arm along said horizontal axis, and a second rod and a second gear combination allow movement of said paint spray arm along said vertical axis.

6. The paint spray apparatus as recited in claim 5, wherein a second motor drives said nozzle to pivot about a swivel point.

7. The paint spray apparatus as recited in claim 2, wherein said plane is essentially perpendicular to a longitudinal axis of said paint spray booth.

8. The paint spray apparatus as recited in claim 1, wherein said motor is mounted off of said paint spray arm.

9. A paint spray apparatus for painting a vehicle in a paint spray booth comprising:

a paint spray arm movably disposed within said paint spray booth having a nozzle disposed at a free end of said paint spray arm;

a pump disposed in said paint spray arm adjacent said nozzle and movably with said arm; and a motor and transmission adapted to drive said pump, said motor disposed away from said pump and off said paint spray arm, and said transmission intermediate said pump and motor, wherein said transmission allows relative movement between said motor and pump along two axes.

10. The paint spray apparatus as recited in claim 9, wherein one of said axes is parallel to a horizontal longitudinal axis of said paint spray arm and the other of said axes is a vertical axis.

11. The paint spray apparatus as recited in claim 10, wherein a first rod and a first gear and belt combination allows relative movement of said paint spray arm and said motor along said horizontal longitudinal axis.

12. The paint spray apparatus as recited in claim 11, wherein a second rod and a second gear and belt combination allows relative movement of said paint spray arm and said motor along said vertical axis, each of said rods and said gear combinations being connected to transfer the actuation of said motor through said transmission to drive said pump.

13. The paint spray apparatus as recited in claim 12, wherein each of said rods has a non-circular outer periphery along substantially the entire length of said rods, and each of said gear and belt combinations comprise a disk gear having a corresponding inner periphery, each of said disk gears moveable along said length of one of said rods.

14. A paint spray apparatus for painting a vehicle in a paint spray booth comprising:

a paint spray arm movably disposed within said paint spray booth having a nozzle disposed at a free end of said paint spray arm;

a pump mounted on said paint spray arm adjacent said nozzle and movable with said arm;

a first motor and first transmission adapted to drive said pump, said first motor disposed away from said pump, off said paint spray arm, and outside said paint spray booth, and said first transmission disposed intermediate said pump and said first motor, a second motor and second transmission adapted to move said paint spray arm along a horizontal longitudinal axis of said paint spray arm; and a third motor and third transmission adapted to move said paint spray arm along a vertical axis, wherein said first transmission allows said paint spray arm to move in a plane defined by said vertical and said longitudinal horizontal axes, and still transmit rotation from said first motor to said pump.

15. The paint spray apparatus as recited in claim 14, wherein said plane is essentially perpendicular to a longitudinal axis of said paint spray booth.

16. The paint spray apparatus as recited in claim 15, wherein said first transmission comprises a plurality of rods and a plurality of gear combinations.

17. The paint spray apparatus as recited in claim 16, wherein said rods have a non-circular outer periphery, and each of said gear combinations have a corresponding inner periphery to slide along one of said rods, and also rotate with one of said rods.

18. The paint spray apparatus as recited in claim 17, wherein said rods each have a plurality of elongate splines along substantially the entire length of said rods, and said gear combinations each comprise a disk gear having a plurality of ridges along an inner periphery of said disk gears, said disk gears moveable along said length of one of said rods.

19. The paint spray apparatus as recited in claim 18, wherein a fourth motor controls said nozzle such that said nozzle pivots about a swivel point.

* * * * *